US009617710B2

(12) United States Patent
Shimada

(10) Patent No.: US 9,617,710 B2
(45) Date of Patent: Apr. 11, 2017

(54) WORK VEHICLE AND METHOD FOR CONTROLLING WORK VEHICLE

(71) Applicant: KOMATSU LTD., Tokyo (JP)

(72) Inventor: Kenjiro Shimada, Komatsu (JP)

(73) Assignee: KOMATSU LTD., Tokyo (JP)

( * ) Notice: Subject to any disclaimer, the term of this patent is extended or adjusted under 35 U.S.C. 154(b) by 307 days.

(21) Appl. No.: 14/379,000

(22) PCT Filed: Jun. 18, 2014

(86) PCT No.: PCT/JP2014/066105

§ 371 (c)(1),
(2) Date: Aug. 15, 2014

(87) PCT Pub. No.: WO2014/181894

PCT Pub. Date: Nov. 13, 2014

(65) Prior Publication Data

US 2016/0244940 A1 Aug. 25, 2016

(51) Int. Cl.

| | |
|---|---|
| ***E02F 3/84*** | (2006.01) |
| ***E02F 3/85*** | (2006.01) |
| ***E02F 3/76*** | (2006.01) |
| ***E02F 9/22*** | (2006.01) |
| ***E02F 5/32*** | (2006.01) |

(52) U.S. Cl.

CPC ..... *E02F 3/844* (2013.01); *E02F 3/7604* (2013.01); *E02F 3/7613* (2013.01); *E02F 3/7618* (2013.01); *E02F 5/32* (2013.01); *E02F 9/2296* (2013.01)

(58) Field of Classification Search

CPC ..... E02F 3/845; E02F 3/844; E02F 3/7618

USPC ..... 172/4.5, 2, 4

See application file for complete search history.

(56) References Cited

U.S. PATENT DOCUMENTS 5,499,684 A * 3/1996 Stratton ..... E01C 19/004 172/4.5
5,564,507 A * 10/1996 Matsushita ..... E02F 9/2029 172/3
5,816,335 A * 10/1998 Yamamoto ..... E02F 3/845 172/3
6,062,317 A * 5/2000 Gharsalli ..... E02F 3/841 172/2

(Continued)

FOREIGN PATENT DOCUMENTS

CN 1487155 A 4/2004
CN 1566717 A 1/2005

(Continued)

*Primary Examiner* — John G Weiss

(74) *Attorney, Agent, or Firm* — Drinker Biddle & Reath LLP

(57) ABSTRACT

A work vehicle includes a vehicle body, a blade supported on the vehicle body, a pair of first hydraulic cylinders for moving the blade upward and downward, a pair of second hydraulic cylinders for tilting the blade forward, backward, leftward, and rightward, a pair of stroke sensors for detecting stroke amounts of the pair of first hydraulic cylinders, and a controller for controlling a position of the blade based on a difference in the stroke amounts of the pair of first hydraulic cylinders when, in a state where one second hydraulic cylinder is at the one stroke end or the other stroke end, the other second hydraulic cylinder is driven from one stroke end to the other stroke end.

7 Claims, 12 Drawing Sheets

(56) References Cited

U.S. PATENT DOCUMENTS

| | | | | |
|---|---|---|---|---|
| 6,181,999 | B1 * | 1/2001 | Yamamoto | E02F 3/844 172/4.5 |
| 6,282,453 | B1 * | 8/2001 | Lombardi | E02F 9/2033 700/63 |
| 7,059,124 | B2 * | 6/2006 | Suzuki | E02F 3/844 60/421 |
| 7,588,088 | B2 * | 9/2009 | Zachman | E02F 3/845 172/4.5 |
| 8,548,690 | B2 * | 10/2013 | Hayashi | E02F 3/847 172/4.5 |
| 8,931,572 | B2 * | 1/2015 | Nakata | E02F 3/7613 172/260.5 |
| 9,279,235 | B1 * | 3/2016 | Becicka | E02F 9/2029 |
| 2004/0045289 | A1 | 3/2004 | Ikeda et al. | |
| 2004/0128868 | A1 | 7/2004 | Helbling et al. | |
| 2005/0065689 | A1 * | 3/2005 | Budde | E02F 3/845 701/50 |
| 2015/0330057 | A1 * | 11/2015 | Faivre | E02F 3/7618 701/50 |

FOREIGN PATENT DOCUMENTS

| | | | |
|---|---|---|---|
| JP | 2001-107385 | A | 4/2001 |
| JP | 2010-255292 | A | 11/2010 |
| JP | 2014-031696 | A | 2/2014 |

* cited by examiner

WORK VEHICLE AND METHOD FOR CONTROLLING WORK VEHICLE

TECHNICAL FIELD

The present invention relates to a work vehicle, and more particularly to a work vehicle including a blade and a method for controlling the work vehicle.

BACKGROUND ART

Work vehicles such as a bulldozer and a motor grader include a blade for excavating soil.

PTD 1 discloses a work vehicle including a pair of lift cylinders for moving a blade upward and downward and a pair of pitch/tilt cylinders for tilting the blade forward and backward.

In a work vehicle, it is possible to tilt a blade forward, backward, leftward, and rightward by driving both or one of a pair of pitch/tilt cylinders. However, it is necessary to control a position of the blade to perform excavation efficiently.

For example, even when a blade is lifted to a reference height, if the blade tilts forward significantly, an edge of the blade digs into a ground surface, so that excessive excavation is performed. On the other hand, if the blade tilts backward significantly, the edge of the blade is separated apart from the ground surface significantly, so that sufficient excavation cannot be performed.

On this point, four stroke sensors provided respectively to a pair of lift cylinders and a pair of pitch/tilt cylinders can detect stroke amounts to identify a position of the blade.

On the other hand, since stroke sensors are generally expensive, it is preferable that the position of the blade can be identified with use of only two stroke sensors for detecting stroke amounts of the pair of lift cylinders.

According to the work vehicle of PTD 1, a method of automatically controlling a position of the blade based on stroke amounts of a pair of lift cylinders is disclosed.

CITATION LIST

Patent Document

PTD 1: Japanese Patent Laying-Open No. 2014-031696

SUMMARY OF INVENTION

Technical Problem

The work vehicle of PTD 1 includes a pair of pitch/tilt cylinders having different lengths, and a method for controlling a position of the blade to an intermediate tilt by utilizing lengths that a length of one cylinder is about one-half of a length of the other cylinder. However, since it is a control utilizing a mechanism of lengths cylinders, there has been a problem that the control can be used only if the work vehicle includes two different strokes.

The present invention was made to solve the problem described above, and its object is to provide a work vehicle and a method for controlling a work vehicle capable of controlling a position of a blade in a simple manner regardless of respective lengths of a pair of pitch/tilt cylinders.

Other problems and new features will be apparent from the description in the specification and attached drawings.

Solution to Problem

A work vehicle according to one aspect of the present invention includes a vehicle body, a blade supported on the vehicle body, a pair of first hydraulic cylinders for moving the blade upward and downward, a pair of second hydraulic cylinders for tilting the blade forward, backward, leftward, and rightward, a pair of stroke sensors for detecting stroke amount of the first hydraulic cylinders, and a controller for controlling a position of the blade based on a difference in the stroke amounts of the pair of first hydraulic cylinders when, in a state where one second hydraulic cylinder is at one stroke end or the other stroke end, the other second hydraulic cylinder is driven from one stroke end to the other stroke end.

According to the work vehicle of the present invention, the controller controls a position of the blade based on a difference in the stroke amounts of the pair of first hydraulic cylinders when, in a state where one second hydraulic cylinder is at one stroke end or the other stroke end, the other second hydraulic cylinder is driven from one stroke end to the other stroke end. Thus, a position of the blade can be controlled in a simple manner regardless of lengths of cylinders of the respective second hydraulic cylinders.

Preferably, the controller drives the other second hydraulic cylinder from one stroke end to the other stroke end so that the difference in the stroke amounts of the pair of first hydraulic cylinders exhibits a predetermined value, and drives one second hydraulic cylinder from a state of being at one stroke end or the other stroke end until the stroke amounts of the pair of first hydraulic cylinders match.

According to the description above, a position adjustment can be performed by driving the other second hydraulic cylinder so that the difference in the stroke amounts exhibits the predetermined value. Accordingly, a position of the blade can be controlled in a simple manner regardless of the lengths of the cylinders of respective second hydraulic cylinders.

Preferably, the controller sets the predetermined value based on a maximum value at which the difference in the stroke amounts of the pair of first hydraulic cylinders is maximum.

According to the description above, since the predetermined value can be set based on the maximum value, the position adjustment can be performed in a simple manner.

Preferably, the controller calculates a difference in the stroke amounts of the pair of first hydraulic cylinders in a state where the pair of second hydraulic cylinders are at the one stroke end or the other stroke end as a minimum value, and sets the predetermined value based on the maximum value and the minimum value.

According to the description above, since the predetermined value can be set based on the maximum value and the minimum value, the position adjustment can be performed in a simple manner taking an error into consideration.

Preferably, in accordance with an instruction from a manipulator, the controller controls a position of the blade based on a difference in the stroke amounts of the pair of first hydraulic cylinders when one second hydraulic cylinder is driven so as to be in a state of being at one stroke end or the other stroke end and the other second hydraulic cylinder is driven from one stroke end to the other stroke end.

According to the description above, since a position of the blade is controlled in accordance with the instruction from the manipulator, the control can be performed at a timing intended by the manipulator.

Preferably, an adjustment unit for changing a value of the predetermined value in accordance with an instruction from a manipulator is further provided.

According to the description above, a position of the blade can be adjusted in a simple manner in accordance with the instruction from the manipulator.

A method according to one aspect of the present invention for controlling a work vehicle including a pair of first hydraulic cylinders for moving a blade supported on a vehicle body upward and downward, and a pair of second hydraulic cylinders for tilting the blade forward, backward, leftward, and rightward includes the steps of detecting stroke amounts of the pair of first hydraulic cylinders, driving one second hydraulic cylinder so as to be in a state of being at one stroke end or the other stroke end, driving the other second hydraulic cylinder from one stroke end to the other stroke end so that a difference in the stroke amounts of the pair of first hydraulic cylinders exhibits a predetermined value, and driving the one second hydraulic cylinder from the state of being at one stroke end or the other stroke end until the detected stroke amounts of the pair of first hydraulic cylinders match.

The method according to the present invention for controlling a work vehicle includes the steps of driving the other second hydraulic cylinder from one stroke end to the other stroke end in a state where one second hydraulic cylinder is in the state of being at one stroke end or the other stroke end, and driving the one second hydraulic cylinder from a state of being at one stroke end or the other stroke end until the detected stroke amounts of the pair of first hydraulic cylinders match. Thus, a position of the blade can be controlled in a simple manner regardless of lengths of the cylinders of the respective second hydraulic cylinders.

Advantageous Effects of Invention

As described above, according to the work vehicle of the present invention, since a tilt of the blade is adjusted so as to exhibit a predetermined tilt based on a difference in the stroke amounts of the pair of first hydraulic cylinders, a position of the blade can be controlled in a simple manner regardless of the lengths of cylinders of the respective second hydraulic cylinders.

DESCRIPTION OF EMBODIMENT

In the following, the embodiment will be described with reference to the drawings.

In the following, a bulldozer as one example of a "work vehicle" will be described with reference to the drawings.

In the following description, the terms "up," "down," "front," "back," "left," and "right" are defined based on an operator seated on a driver's seat as a reference.

<Overall Configuration>

Figure 1:
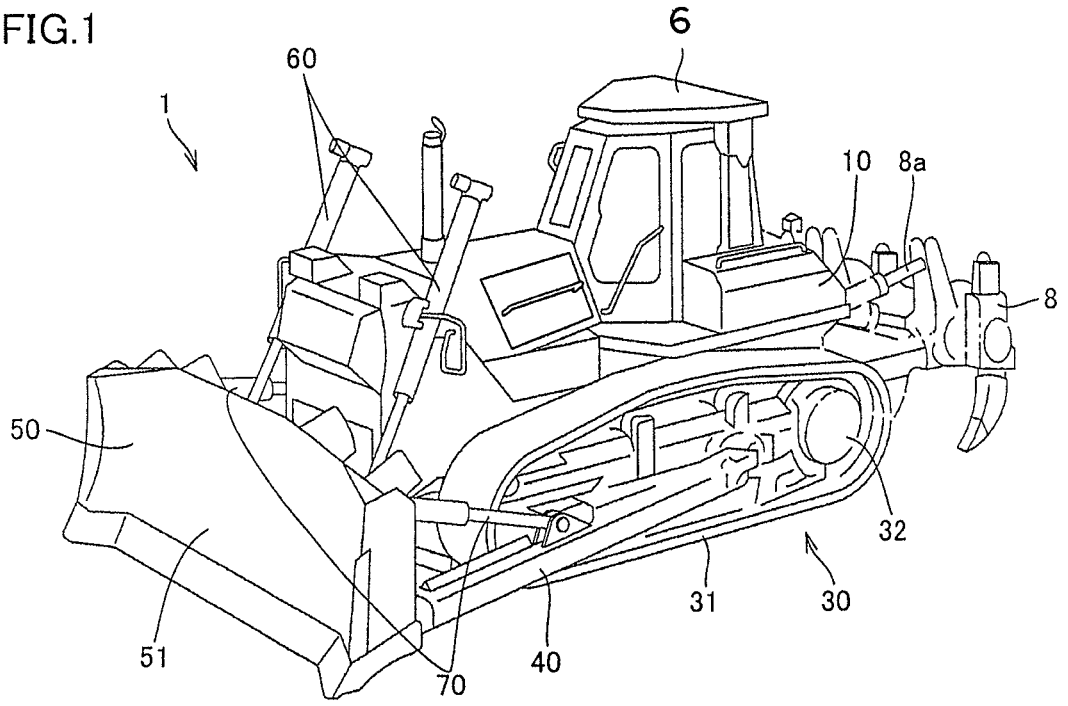
FIG. 1 is a front perspective view representing a bulldozer 1 of an embodiment.

FIG. 1 is a front perspective view representing a bulldozer 1 in accordance with the embodiment.

As shown in FIG. 1, bulldozer 1 includes a vehicle body 10, a cab 6, a traveling apparatus 30, a pair of lift frames 40, a blade 50, a pair of lift cylinders 60, a pair of pitch/tilt cylinders 70, and a ripper 8.

Vehicle body 10 supports cab 6. Vehicle body 10 is provided on traveling apparatus 30.

Cab 6 is provided on a center rear side of vehicle body 10 and has a driver's seat for an operator to be seated thereon and a lever, a pedal, and the like for operating traveling apparatus 30 and blade 50.

Traveling apparatus 30 is provided under vehicle body 10 so as to travel freely.

Traveling apparatus 30 has a pair of crawler belts 31 and a pair of sprocket wheels 32. The pair of crawler belts 31 are rotated by the pair of sprocket wheels 32, so that traveling can be performed on a rough ground.

Blade 50 is mounted as a work implement on a front side of vehicle body 10, and is a work implement for excavating a ground surface and carrying earth and sand. Blade 50 is driven by lift cylinders 60 and pitch/tilt cylinders 70 in accordance with an operation of a blade control lever which will be described later.

Ripper 8 is mounted as a work implement on a rear side of vehicle body 10, and allows a ripper point at a tip protruding substantially perpendicularly downward to stick into a rock or the like to perform cutting and breaking by means of a traction force of traveling apparatus 30. Similarly to blade 50, ripper 8 is driven by a hydraulic cylinder 8*a* in accordance with an operation of a ripper control lever which will be described later. Generally, there are provided a lift cylinder for moving ripper 8 upward and downward and a tilt cylinder for moving the tip of ripper 8 forward and backward.

Cab 6 is provided with an operator's seat (driver's seat) for a manipulator (operator) to be seated thereon and levers, pedals, meters, and the like for various kinds of operations.

The pair of lift frames 40 are arranged at both outer sides of the pair of crawler belts 31, provided that the side of vehicle body 10 is an inner side. The pair of lift frames 40 have a right lift frame and a left lift frame.

Rear ends of the pair of lift frames 40 are attached to both outer sides of traveling apparatus 30 rotatably. Front ends of the pair of lift frames 40 are coupled with blade 50.

Blade 50 is arranged on a front side of vehicle body 10. Blade 50 is supported by the pair of lift frames 40, the pair of lift cylinders 60, and the pair of pitch/tilt cylinders 70. Blade 50 is moved upward and downward by the pair of lift cylinders 60. Blade 50 is tilted forward, backward, leftward, and rightward by the pair of pitch/tilt cylinders 70. At a lower end of blade 50, a blade edge 51 is attached which comes into contact with a ground surface during excavation and ground leveling.

<Configuration of Drive System of Blade>

Figure 2:
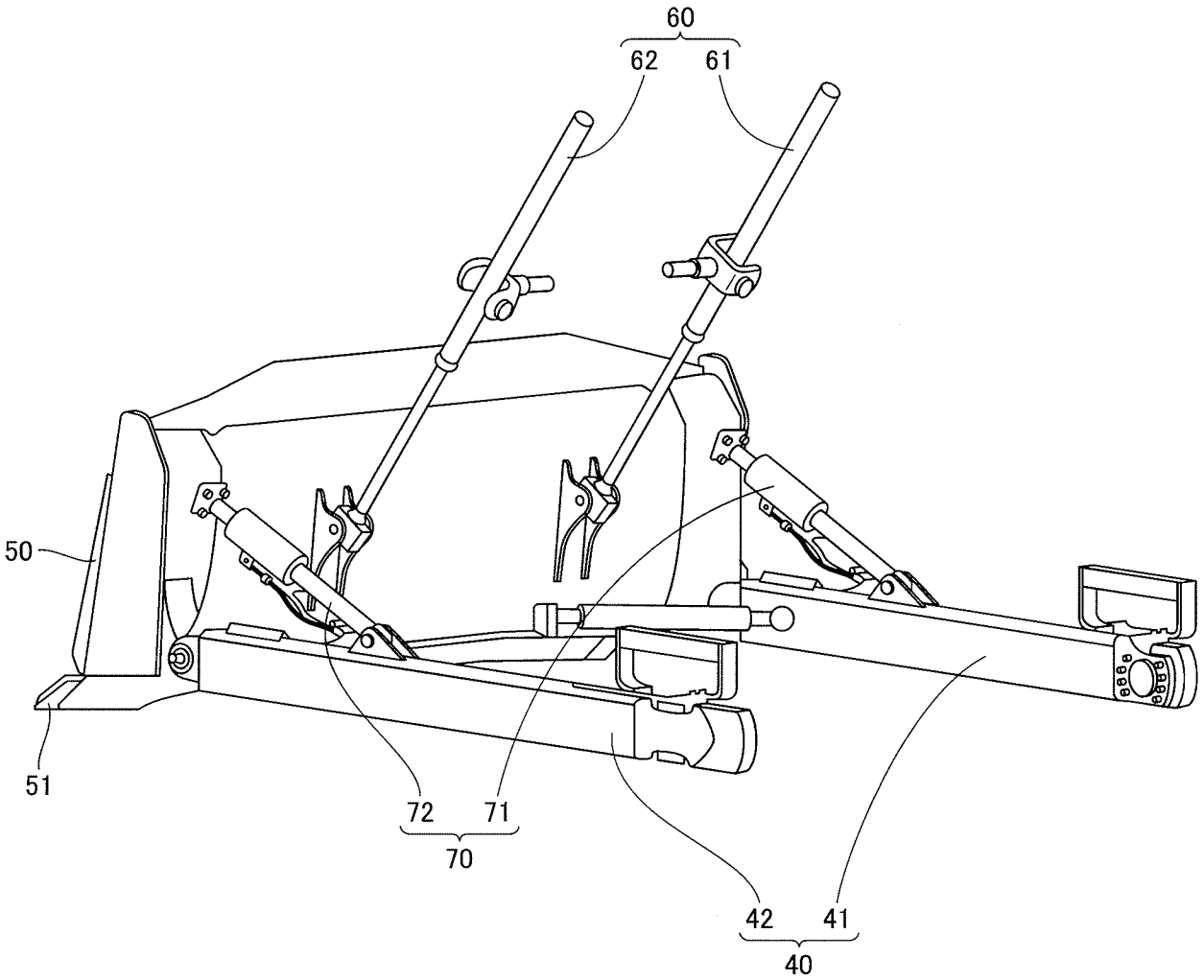
FIG. 2 illustrates a configuration of a drive system of a blade in accordance with the embodiment.

FIG. 2 illustrates a configuration of a drive system of a blade in accordance with the embodiment.

As shown in FIG. 2, the pair of lift cylinders 60 are coupled to vehicle body 10 and blade 50.

The pair of lift cylinders 60 include a right lift cylinder 61 and a left lift cylinder 62. Right lift cylinder 61 and left lift cylinder 62 extend and contract in conjunction with each other by means of hydraulic oil to move blade 50 coupled to lift cylinders 60 upward and downward. The operation of the blade in the upward and downward directions is referred to as a lift operation.

A pair of lift stroke sensors are attached to the pair of lift cylinders 60. The pair of lift stroke sensors have rotary rollers for detecting cylinder positions and magnetic sensors for returning the cylinder positions to origin.

The pair of lift stroke sensors detect a stroke amount of right lift cylinder 61 and a stroke amount of left lift cylinder 62. Here, the stroke amount is a moving amount of the cylinder from the most contracted state of the cylinder. Lift cylinders 60 are coupled to vehicle body 10 and blade 50, and positions of lift cylinders 60 can be detected by the stroke amount detection.

The pair of pitch/tilt cylinders 70 are coupled with the pair of lift frames 40 and blade 50.

The pair of pitch/tilt cylinders 70 have a right pitch/tilt cylinder 71 and a left pitch/tilt cylinder 72. Right pitch/tilt cylinder 71 and left pitch/tilt cylinder 72 extend and contract at the same speed in conjunction with each other by means of hydraulic oil, so that blade 50 is tilted forward and backward. The tilting operation of the blade in the forward and backward directions is referred to as a pitch operation. Extending right pitch/tilt cylinder 71 and left pitch/tilt cylinder 72 together causes blade 50 to tilt forward, and contracting right pitch/tilt cylinder 71 and left pitch/tilt cylinder 72 causes blade 50 to tilt backward. The lengths of the cylinders of right pitch/tilt cylinder 71 and left pitch/tilt cylinder 72 are generally equal. In other words, the strokes of right pitch/tilt cylinder 71 and left pitch/tilt cylinder 72 are generally equal.

Extending and contracting only left pitch/tilt cylinder 72 in a state of not extending and contracting right pitch/tilt cylinder 71 cause the left side of blade 50 to move substantially upward and downward. Extending only left pitch/tilt cylinder 72 causes blade 50 to tilt rightward, and contracting only left pitch/tilt cylinder 72 causes blade 50 to tilt leftward.

On the other hand, extending and contracting only right pitch/tilt cylinder 71 in a state of not extending and contracting left pitch/tilt cylinder 72 causes the right side of blade 50 to move substantially upward and downward. Extending only right pitch/tilt cylinder 71 causes blade 50 to tilt leftward, and contracting only right pitch/tilt cylinder 71 causes blade 50 to tilt rightward.

This tilting operation of blade 50 in the leftward and rightward directions is referred to as a tilt operation. When the tilt operation causes blade 50 to tilt in the leftward and rightward directions, a difference occurs in the stroke amounts between right lift cylinder 61 and left lift cylinder 62, so that the cylinder positions become non-parallel. When blade 50 is at a horizontal position of not tilting leftward and rightward, the stroke amounts of right lift cylinder 61 and left lift cylinder 62 become equal, so that the cylinder positions become parallel.

<Configuration of Cab 6>

Figure 3:
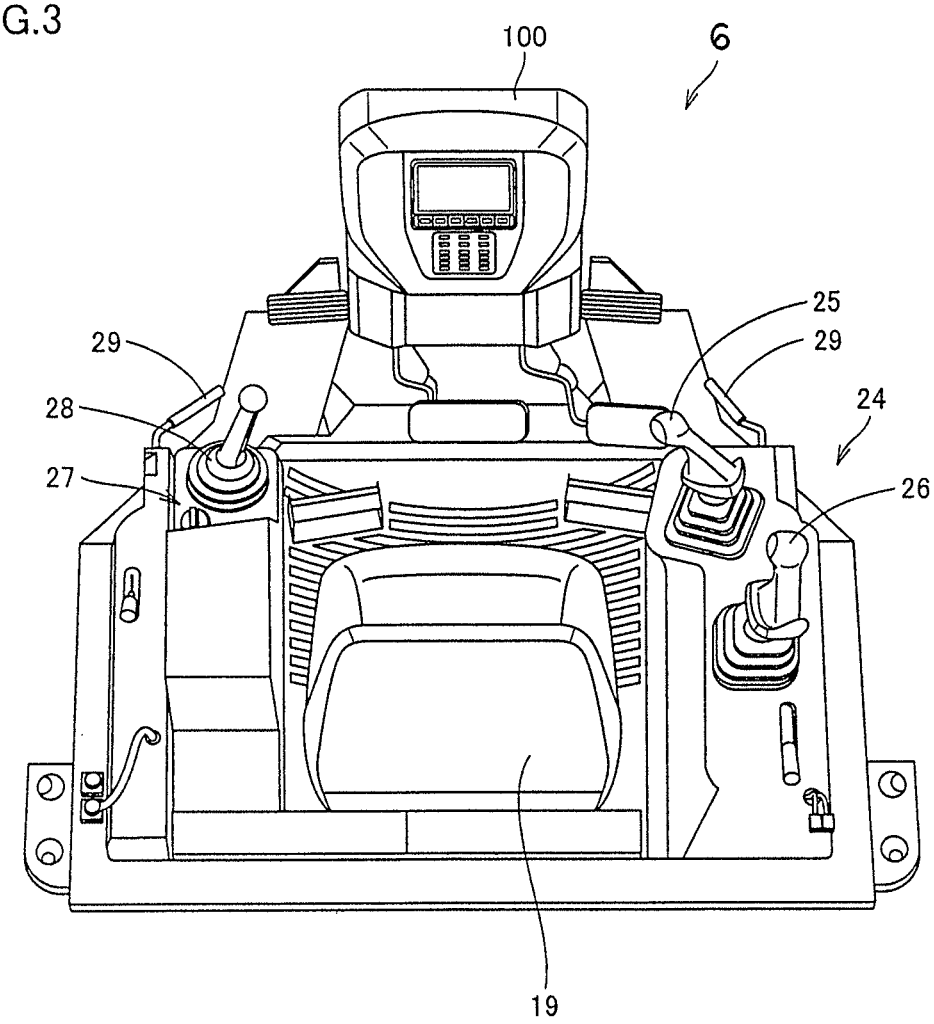
FIG. 3 is a perspective view representing an internal configuration of a cab 6 in accordance with the embodiment.

FIG. 3 is a perspective view representing an internal configuration of cab 6 in accordance with the embodiment.

As shown in FIG. 3, cab 6 has an operator's seat 19, a right side operating device 24, a left side operating device 27, an operation panel 100, lock levers 29, and the like.

Operator's seat 19 is a seat for an operator (manipulator) who gets in and out of the cab to be seated thereon and perform driving operation, and is provided in a state of being slidable in forward and backward directions.

In front of this operator's seat 19, there is provided operation panel 100 which can be operated by the operator (manipulator) in a seated state. The manipulator can operate operation panel 100 to perform various kinds of settings for bulldozer 1. Operation panel 100 is provided so as to be able to notify the operator of an engine state of the bulldozer and receive setting instructions related to various operations. The engine state includes, for example, a temperature of engine coolant water, a hydraulic oil temperature, a fuel remaining amount, and the like. Moreover, the various operations include settings related to a pitch adjusting function which will be described later.

On the left and right sides of this operator's seat 19, there are provided operation equipments such as a control lever or the like to be operated by a manipulator.

Right side operating device 24 is arranged on a right side of operator's seat 19 viewed from a manipulator seated on operator's seat 19. On an upper side of right side operating device 24, there are provided a blade control lever 25 for performing operations of blade 50, such as the upward and downward operation, the pitch operation, the tilt operation, and the like, a ripper control lever 26, and the like.

Left side operating device 27 is arranged on a left side of operator's seat 19 viewed from a manipulator seated on operator's seat 19. On an upper side of left side operating device 27, there is provided a traveling control lever 28 and the like. Traveling control lever 28 is swung in the forward and backward directions and leftward and rightward directions, provided that the direction in which the vehicle moves forward is defined as the front side, to perform steering operation.

Lock levers 29 are provided near traveling control lever 28 and blade control lever 25, respectively. In this example, lock levers 29 provided on the left and right sides are coupled, so that upward and downward operation to the one similarly moves the other. In this example, the configuration in which lock levers 29 are provided on both sides is described. However, the configuration of providing lock lever 29 on one side can be also employed. Here, lock levers 29 are used for stopping functions such as operation of work implements (blade 50 and ripper 8), traveling of traveling apparatus 30, and the like. Performing an operation of positioning lock levers 29 to a lowered state (here, the lowering operation of the lock levers) can lock (restrict) movement of work implements and the like. In the state where movement of the work implements and the like are locked by lock levers 29, the work implements and the like do not operate even if a manipulator operates blade control lever 25, traveling control lever 28, or the like.

<Configuration of Hydraulic Drive System>

Next, a hydraulic drive system of bulldozer 1 will be described.

Figure 4:
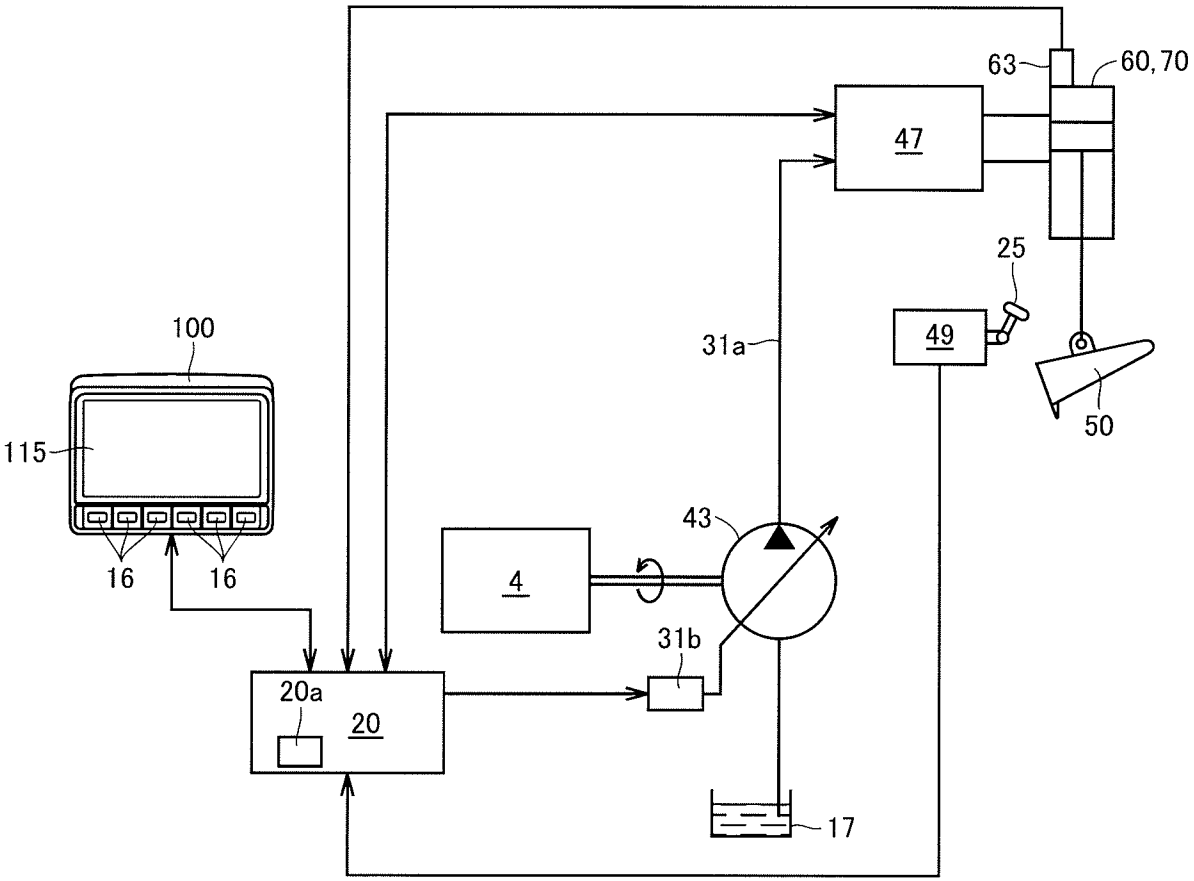
FIG. 4 is a circuit diagram representing a hydraulic drive system of bulldozer 1 in accordance with the embodiment.

FIG. 4 is a circuit diagram representing a hydraulic drive system of bulldozer 1 in accordance with the embodiment.

As shown in FIG. 4, the drive system of bulldozer 1 includes blade 50, engine 4, a hydraulic pump 43, a pipe line 31*a*, a hydraulic oil tank 17, controller 20, a servo valve 31*b*, a control valve 47, lift cylinders 60, pitch/tilt cylinders 70, an operation detector 49, a blade control lever 25, an operation panel 100, and lift stroke sensors 63.

For the work implement (here, as represented by blade 50) shown in FIG. 1, engine 4 drives hydraulic pump 43 of a variable capacity type.

The hydraulic oil discharged from hydraulic pump 43 flows into control valve 47 via pipe line 31*a* and supplied to lift cylinders 60 and pitch/tilt cylinders 70 by the operation of control valve 47. Extension and contraction of lift cylinders 60 and pitch/tilt cylinders 70 allow the tilting operation of blade 50 in forward, backward, leftward, and rightward direction to be performed. The returning oil from lift cylinders 60 and pitch/tilt cylinders 70 returns to hydraulic oil tank 17 via a pipe line not illustrated in the drawings.

Operation detector 49 outputs to controller 20 commands in accordance with various inputs to blade control lever 25.

Controller 20 controls control valve 47 and servo valve 31*b* in accordance with a command from operation detector 49. A discharging amount of hydraulic pump 43 is controlled by the operation of servo valve 31*b*, and speeds of lift cylinders 60 and pitch/tilt cylinders 70 are controlled by this variable discharging amount. Servo valve 31*b* controls a tilting angle of a swash plate of hydraulic pump 43.

In this example, the method of driving blade 50 by means of blade control lever 25 causing lift cylinders 60 and pitch/tilt cylinders 70 to extend and contract is described. Although not illustrated in the drawings, ripper control lever 26 causes hydraulic cylinder 8*a* to extend and contract to drive ripper 8 in the similar manner.

Controller 20 is a controller which entirely controls bulldozer 1, and is constituted of a CPU (Central Processing Unit), a nonvolatile memory, a timer, and the like. Moreover, controller 20 has a storage 20*a* storing control data and the like.

Operation panel 100 is connected to controller 20 to receive various kinds of operation instructions. In this example, with regard to a pitch initial adjustment function which will be described later, operation panel 100 receives an instruction from a manager and instructs controller 20 to execute a pitch initial adjustment process.

Lift stroke sensors 63 are provided at lift cylinders 60, and detect stroke amounts of the pair of lift cylinders 60 and output the stroke amounts to controller 20.

Figure 5:
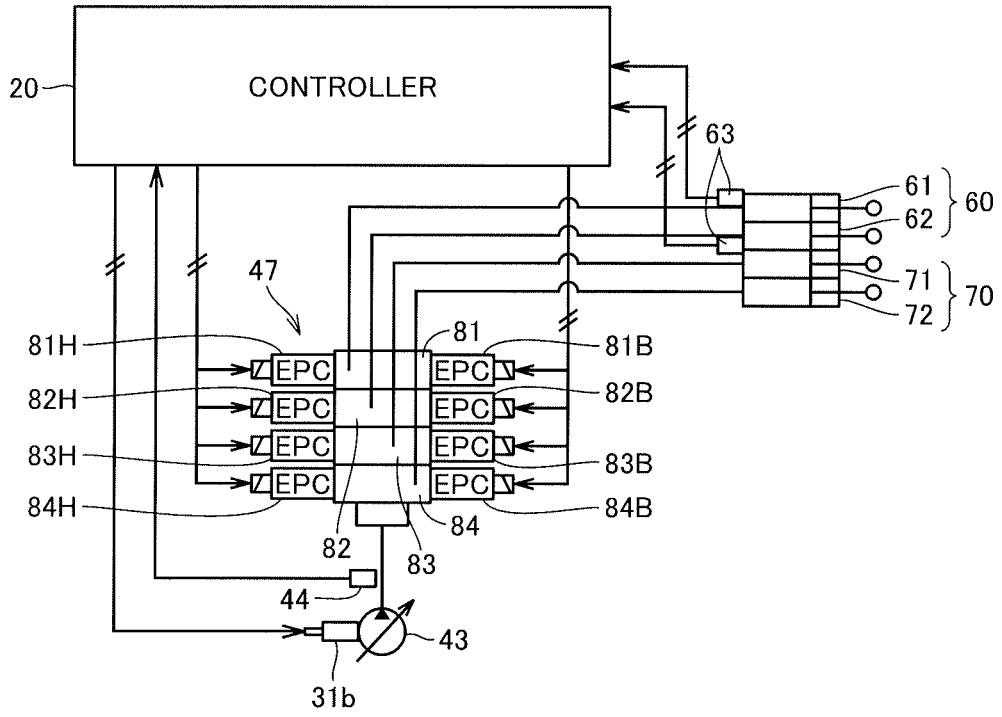
FIG. 5 illustrates an operation of a control valve 47 in accordance with the embodiment.

FIG. 5 illustrates operation of control valve 47 in accordance with the embodiment.

As shown in FIG. 5, the pair of lift cylinders 60, the pair of lift stroke sensors 63, the pair of pitch/tilt cylinders 70, controller 20, hydraulic pump 43, pump pressure detect sensor 44, and servo valve 31*b* are provided.

The pair of lift cylinders 60 have right lift cylinder 61 and left lift cylinder 62. The pair of pitch/tilt cylinders 70 have right pitch/tilt cylinder 71 and left pitch/tilt cylinder 72.

Controller 20 sends control signals to control valve 47 based on commands in accordance with various control inputs of blade control lever 25, so that hydraulic pump 43 can supply hydraulic oil through pipe line 31*a* to right lift cylinder 61, left lift cylinder 62, right pitch/tilt cylinder 71, and left pitch/tilt cylinder 72, separately.

Control valve 47 has a plurality of valve units 81 to 84, EPC valves (Electromagnetic Proportional Control valves) 81B to 84B and 81H to 84H.

Right lift cylinder 61 is connected to valve unit 81. Valve unit 81 is provided with EPC valves 81B, 81H. A current is outputted from controller 20 to EPC valves 81B, 81H to control opening and closing operations of the valves coupled to pipe line 31*a*, so that the stroke amount of right lift cylinder 61 is adjusted. Controller 20 outputs a current to EPC valve 81B to contract right lift cylinder 61, and outputs a current to EPC valve 81H to extend right lift cylinder 61.

Left lift cylinder 62 is connected to valve unit 82. Valve unit 82 is provided with EPC valves 82B, 82H. A current is outputted from controller 20 to EPC valves 82B, 82H to control opening and closing operations of the valves connected to pipe line 31*a*, so that the stroke amount of left lift cylinder 62 is adjusted. Controller 20 outputs a current to EPC valve 82B to contract left cylinder 62, and outputs a current to EPC valve 82H to extend left lift cylinder 62.

Right pitch/tilt cylinder 71 is connected to valve unit 83. Valve unit 83 is provided with EPC valves 83B, 83H. A current is outputted from controller 20 to EPC valves 83B, 83H to control opening and closing operations of the valves coupled to pipe line 31*a*, so that the stroke amount of right pitch/tilt cylinder 71 is adjusted. Controller 20 outputs a current to EPC valves 83B to contract right pitch/tilt cylinder 71, and outputs a current to EPC valve 83H to extend right pitch/tilt cylinder 71.

Left pitch/tilt cylinder 72 is connected to valve unit 84. Valve unit 84 is provided with EPC valves 84B, 84H. A current is outputted from controller 20 to EPC valves 84B, 84H to control opening and closing operations of the valves coupled to pipe line 31*a*, so that the stroke amount of left pitch/tilt cylinder 72 is adjusted. Controller 20 outputs a current to EPC valve 84B to contract left pitch/tilt cylinder 72, and outputs a current to EPC valve 84H to extend left pitch/tilt cylinder 72.

Controller 20 can drive each cylinder independently.

Pump pressure detect sensor 44 detects a pump pressure of hydraulic pump 43 at pipe line 31*a*, and outputs the detected pump pressure to controller 20.

For example, in accordance with a pitch-back operation of operating blade control lever 25 to instruct a tilting operation of tilting blade 50 backward, controller 20 outputs a current to EPC valves 83B and EPC valve 84B. Accordingly, right pitch/tilt cylinder 71 and left pitch/tilt cylinder 72 contract.

When both right pitch/tilt cylinder 71 and left pitch/tilt cylinder 72 are driven to one stroke ends, the pump pressure in pipe line 31*a* is raised. Accordingly, pump pressure detect sensor 44 detects a predetermined relief pressure. In accordance with the detection of the predetermined relief pressure, the state in which both right pitch/tilt cylinder 71 and left pitch/tilt cylinder 72 are most contracted can be detected.

Controller 20 determines whether or not the pitch-back operation is present. When it is determined that the pitch-back operation is present, and the predetermined relief pressure is detected, the position control of blade 50 is started. The relief pressure is a pressure given when the pump pressure in pipe line 31*a* exceeds a predetermined value to open the relief valve.

In accordance with a pitch-forward operation of operating blade control lever 25 to instruct a tilting operation of tilting blade 50 forward, controller 20 outputs a current to EPC valve 83H and EPC valve 84H. Accordingly, right pitch/tilt cylinder 71 and left pitch/tilt cylinder 72 extend.

When both right pitch/tilt cylinder 71 and left pitch/tilt cylinder 72 are driven to the other stroke ends, the pump pressure in pipe line 31*a* is raised. Accordingly, pump pressure detect sensor 44 detects a predetermined relief pressure. In accordance with the detection of the predetermined relief pressure, the state in which both right pitch/tilt cylinder 71 and left pitch/tilt cylinder 72 are most extended can be detected.

In accordance with a left-tilt operation of operating blade control lever 25 to instruct a tilting operation of tilting the left side of blade 50 substantially upward and downward, controller 20 outputs a current to EPC valve 84B or EPC valve 84H. Left pitch/tilt cylinder 72 extends and contracts in accordance with an instruction of the left-tilt operation. When left pitch/tilt cylinder 72 is driven to a state of being most contracted (one stroke end) or a state of being most extended (other stroke end) in accordance with an instruction of the left-tilt operation, the pump pressure of pipe line 31*a* is raised. Accordingly, pump pressure detect sensor 44 detects a predetermined relief pressure. In accordance with the detection of the predetermined relief pressure, it is possible to detect the state in which left pitch/tilt cylinder 72 is most contracted or the state in which left pitch/tilt cylinder 72 is most extended.

In accordance with a right-tilt operation of operating blade control lever 25 to instruct a tilting operation of tilting the right side of blade 50 substantially upward and downward, controller 20 outputs a current to EPC valve 83B or EPC valve 83H. Right pitch/tilt cylinder 71 extends and contracts in accordance with an instruction of the right-tilt operation. When right pitch/tilt cylinder 71 is driven to a state of being most contracted (one stroke end) or a state of being most extended (other stroke end) in accordance with an instruction of the right-tilt operation, the pump pressure of pipe line 31*a* is raised. Accordingly, pump pressure detect sensor 44 detects a predetermined relief pressure. In accordance with the detection of the predetermined relief pressure, it is possible to detect the state in which right pitch/tilt cylinder 71 is most contracted or the state in which right pitch/tilt cylinder 71 is most extended.

<Reference Position>

Figure 6:
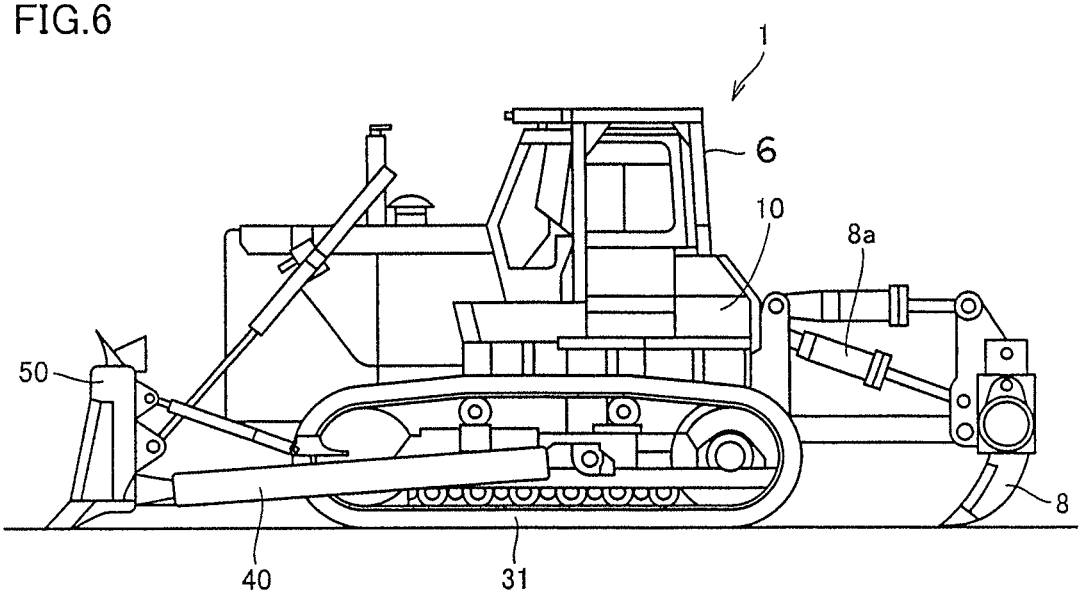
FIG. 6 illustrates a reference position of a blade 50 of bulldozer 1 in accordance with the embodiment.

FIG. 6 represents a reference position of blade 50 of bulldozer 1 in accordance with the embodiment.

As shown in FIG. 6, the reference position of blade 50 represents a state where a lower end of a track shoe plate (shoe plate) of crawler belt 31 is lowered to a GL line (GL: Ground Line), and a state where blade 50 is horizontal and the blade edge of blade 50 is lowered to a height of the crawler belts. The horizontal state of blade 50 represents a state where blade 50 has a certain tilt in forward and backward directions and is not tilted in leftward and right ward.

Crawler belt 31 is formed to be annular by coupling in an endless manner a plurality of crawler belt links to which the track shoe plate is disposed.

Excavation work can be performed by setting blade 50 to take the reference position. The predetermined tilt represents a predetermined angle between blade edge 51 of blade 50 and the GL line in the reference position and at which blade edge 51 of blade 50 does not dig into the ground surface excessively and not separate apart significantly from the ground surface.

In the following, a position control of automatically adjusting the tilt of blade 50 will be described.

<Position Control>

Figure 7:
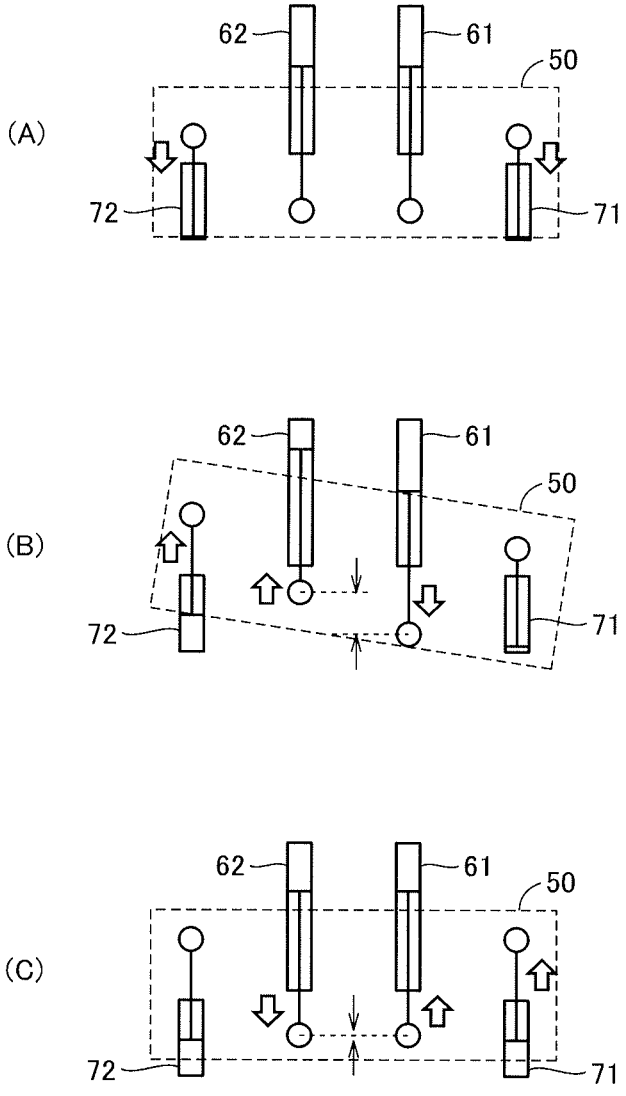
FIG. 7 illustrates a position control of blade 50 of bulldozer 1 in accordance with the embodiment.

FIG. 7 illustrates the position control of blade 50 of bulldozer 1 in accordance with the embodiment.

As shown in FIG. 7(A), pitch/tilt cylinders 70 are driven to one stroke ends of pitch/tilt cylinders 70. Specifically, right pitch/tilt cylinder 71 and left pitch/tilt cylinder 72 are contracted together to allow blade 50 to perform tilting operation in the backward direction.

In this case, the stroke amounts of right lift cylinder 61 and left lift cylinder 62 are substantially equal. Thus, a difference is substantially lost.

As shown in FIG. 7(B), next, the state of the stroke end in right pitch/tilt cylinder 71 is maintained, and left pitch/tilt cylinder 72 is driven from one stroke end to the other stroke end. Specifically, left pitch/tilt cylinder 72 is extended. Accordingly, a difference in the stroke amounts between right lift cylinder 61 and left lift cylinder 62 starts to occur.

When the difference in the stroke amounts between right lift cylinder 61 and left lift cylinder 62 exhibits a predetermined value, driving of left pitch/tilt cylinder 72 from one stroke end to the other stroke end is stopped. Specifically, extension of left pitch/tilt cylinder 72 is stopped.

As shown in FIG. 7(C), next, while maintaining the state of the stroke end in left pitch/tilt cylinder 72, right pitch/tilt cylinder 71 is driven from one stroke end to the other stroke end. Specifically, right pitch/tilt cylinder 71 is extended. Accordingly, the difference in the stroke amounts between right lift cylinder 61 and left lift cylinder 62 becomes small.

When the stroke amounts of right lift cylinder 61 and left lift cylinder 62 match, the driving of right pitch/tilt cylinder 71 from one stroke end to the other stroke end is stopped. Specifically, extension of right pitch/tilt cylinder 71 is stopped.

The case where the stroke amounts match includes not only the case where a difference in detected values of the stroke amounts given by the respective stroke sensors of right lift cylinder 61 and left lift cylinder 62 becomes 0, but also the case where the difference is within a predetermined range. The same applies in the following.

Figure 8:
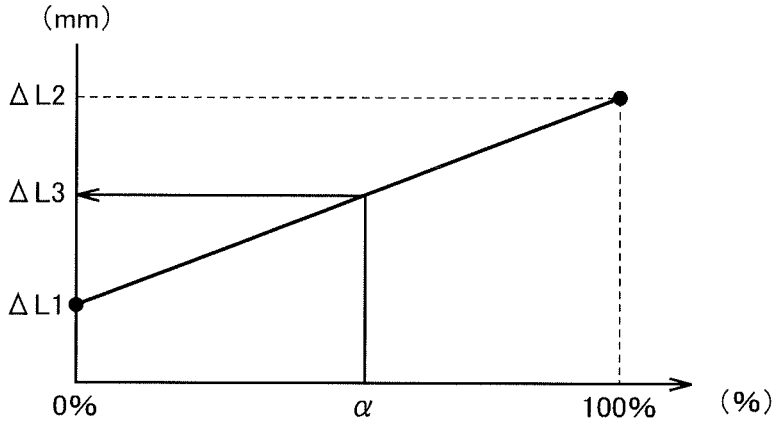
FIG. 8 illustrates a difference in stroke amounts changed along with extension and contraction of pitch/tilt cylinders 70 used for a position control of blade 50 of bulldozer 1 in accordance with the embodiment.

FIG. 8 illustrates the difference in the stroke amounts changed in accordance with extension and contraction of pitch/tilt cylinders 70 for use in the position control of blade 50 of bulldozer 1 in accordance with the embodiment.

Referring to FIG. 8, the vertical axis here denotes the difference in the stroke amounts between right lift cylinder 61 and left lift cylinder 62. Moreover, the horizontal axis denotes the extension rate of left pitch/tilt cylinder 72. The data is stored in storage 20*a* of controller 20.

The extension rate "0%" represents the state where pitch/tilt cylinders 70 are driven to one stroke ends. Specifically, it represents the state where among pitch/tilt cylinders 70 both cylinders of right pitch/tilt cylinder 71 and left pitch/tilt cylinder 72 are most contracted. It represents the state where tilting operation of blade 50 in the backward direction (the direction in which the blade edge lies) is performed.

The difference in the stroke amounts between right lift cylinder 61 and left lift cylinder 62 for the case of extension rate "0%" is indicated as $\Delta L1$. This is a value which occurs due to a manufacture error of pitch/tilt cylinders 70 or due to a fitting error of blade 50. When an error does not occur, $\Delta L1$ is "0."

In this example, only left pitch/tilt cylinder 72 is extended. Right pitch/tilt cylinder 71 maintains the most contracted state.

The extension rate "100%" represents the state where left pitch/tilt cylinder 72 is driven to the stroke end of pitch/tilt cylinder 70. Specifically, it represents the state where left pitch/tilt cylinder 72 is most extended. On the other hand, right pitch/tilt cylinder 71 is in the most contracted state.

The difference in the stroke amounts between right lift cylinder 61 and left lift cylinder 62 for the case of the extension rate "100%" is represented as $\Delta L2$. This is the difference in the stroke amounts in the state where left/tilt cylinder 72 is most extended while in the state where right pitch/tilt cylinder 71 is most contracted.

Thus, based on the data of FIG. 8 and the difference in the stroke amounts between right lift cylinder 61 and left lift cylinder 62, the stroke amount of left pitch/tilt cylinder 72 can be adjusted to a predetermined position between one stroke end to the other stroke end of left pitch/tilt cylinder 72.

The cylinder position can be set by extending left/tilt cylinder 72 based on the difference in the stroke amounts between right lift cylinder 61 and left lift cylinder 62.

For example, when it is desired to set the stroke amount of left pitch/tilt cylinder 72 to be at an intermediate position (extension rate $\alpha$=50%) between one stroke end and the other stroke end, left pitch/tilt cylinder 72 is driven from one stroke end to the other stroke end so that the difference in the stroke amounts between right lift cylinder 61 and left lift cylinder 62 becomes an intermediate value $\Delta L3$ between $\Delta L1$ and $\Delta L2$ (=($\Delta L1+\Delta L2$)/2). Accordingly, left pitch/tilt cylinder 72 is set to be at an intermediate position (extension rate $\alpha$=50%) between one stroke end and the other stroke end.

Next, right pitch/tilt cylinder 71 is driven from one stroke end to the other stroke end. With this operation, the difference in the stroke amounts between right lift cylinder 61 and left lift cylinder 62 becomes smaller from $\Delta L3$. Right pitch/tilt cylinder 71 is driven from one stroke end to the other stroke end until the stroke amounts of right lift cylinder 61 and left lift cylinder 62 match (until the difference in the stroke amounts is eliminated). Accordingly, blade 50 can be horizontal by eliminating the difference in the stroke amounts between right lift cylinder 61 and left lift cylinder 62. Right pitch/tilt cylinder 71 is located at substantially the same intermediate position as the position of left pitch/tilt cylinder 72.

This is a method of rendering blade 50 to be horizontal by positioning left pitch/tilt cylinder 72 based on the difference in the stroke amounts between right lift cylinder 61 and left lift cylinder 62, and driving right pitch/tilt cylinder 71 based on the difference in the stroke amounts between right lift cylinder 61 and left lift cylinder 62 to eliminate the difference in the amount between right lift cylinder 61 and left lift cylinder 62. By adjusting the cylinder positions to predetermined positions, the position of the blade can be controlled so that blade 50 has a predetermined tilt.

Since the tilt of blade 50 is adjusted so as to have a predetermined tilt based on the difference in the stroke amounts between right lift cylinder 61 and left lift cylinder 62, the position of blade 50 can be controlled in a simple manner regardless of the lengths of right pitch/tilt cylinder 71 and left pitch/tilt cylinder 72.

In this example, the case is described where for example the stroke amount of left pitch/tilt cylinder 72 is set to be at an intermediate position between one stroke end and the other stroke end. However, not particularly limited to left pitch/tilt cylinder 72, right pitch/tilt cylinder 71 can be set so as to be at an intermediate position between one stroke end and the other stroke end, so that the position of the blade can be controlled by driving left pitch/tilt cylinder 72 in accordance with the similar method until right lift cylinder 61 and left lift cylinder 62 match.

Moreover, in this example, the case is described where left pitch/tilt cylinder 72 is driven from the state of being at one stroke end to the other stroke end so that the stroke amount of left pitch/tilt cylinder 72 is at an intermediate position between one stroke end and the other stroke end. However, this can be similarly applied to the case of driving from the state of being at the other stroke end to one stroke end. The adjustment of contracting from the most extended state of left pitch/tilt cylinder 72 to a predetermined position can also be made.

Moreover, in this example, the case is described where the position control is executed to the tilt of blade 50 to have a tilt in an intermediate state between the most contracted state of pitch/tilt cylinders 70 and the most extended state of pitch/tilt cylinders 70. While the case is described where an intermediate state between the state where blade 50 is operated to tilt in the backward direction (the direction of allowing the blade edge to stand) and the state where blade 50 is operated to tilt in the forward direction (the direction of allowing the blade edge to lie) is obtained, adjustment of the value of $\Delta L3$ can be also used to set the state of being operated to tilt in the direction of allowing the blade edge to stand from the angle of the blade edge in the intermediate state, or the state of being operated to tilt in the direction of allowing the blade edge to lie from the angle of the blade edge in the intermediate state.

Specifically, the tilt of blade 50 can be adjusted by adjusting the value of $\Delta L3$ with extension rate $\alpha$ (=50%) increased or decreased by +$\beta$% in accordance with the data of FIG. 8.

<Position Control Process>

Figure 9:
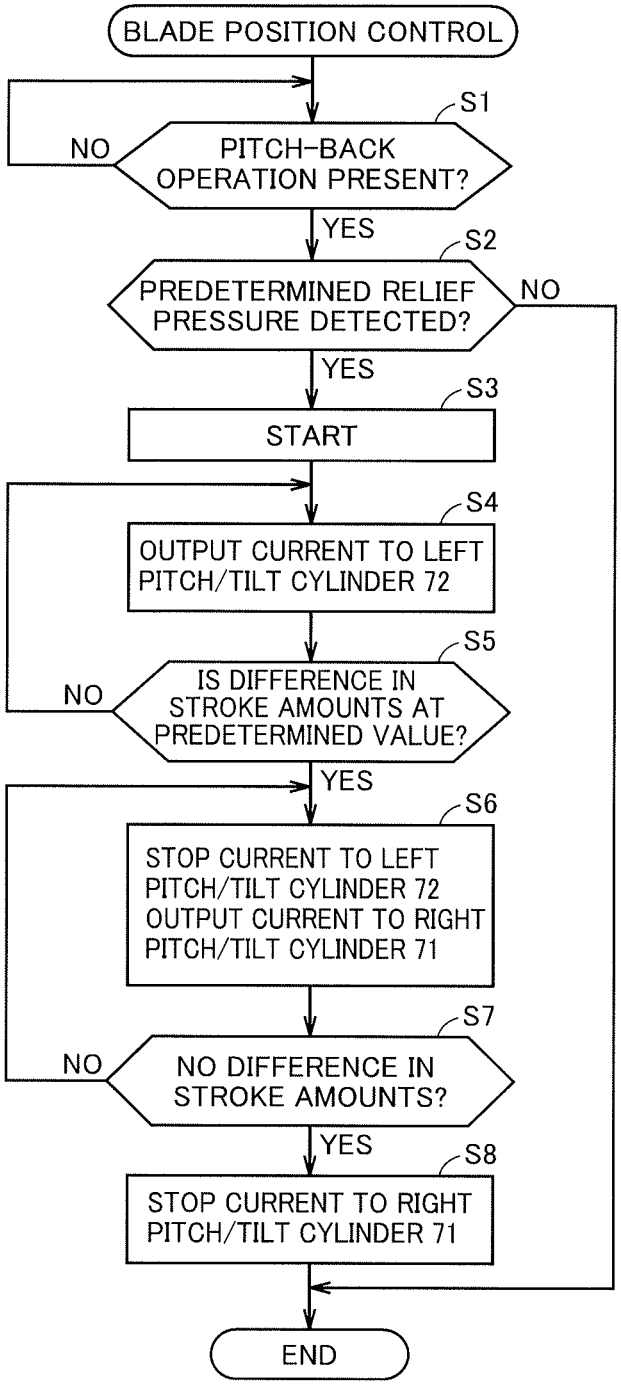
FIG. 9 is a flowchart illustrating a position control process in accordance with the embodiment.

FIG. 9 is a flowchart illustrating the position control process in accordance with the embodiment.

As shown in FIG. 9, controller 20 determines whether or not the pitch-back operation is present (step S1). The pitch-back operation is the operation of allowing blade 50 to tilt in the backward direction by means of blade control lever 25.

Specifically, controller 20 determines whether or not the pitch-back operation is present by receiving an operation command from operation detector 49 in accordance with blade control lever 25.

Next, when it is determined that the pitch-back operation is present (YES in step S1), controller 20 determines whether or not a predetermined relief pressure is detected (step S2). Specifically, controller 20 determines whether or not the pump pressure of pipe line 31*a* detected by pump pressure detect sensor 44 has a value of a predetermined relief pressure. When both right pitch/tilt cylinder 71 and left pitch/tilt cylinder 72 are driven to one stroke ends, the predetermined relief pressure is detected.

Thus, when the predetermined relief pressure is detected during the pitch-back operation, it is understood that the cylinders are in the most contracted state.

In step S2, when it is determined that the predetermined relief pressure is detected (YES in step S2), the position control of blade 50 is started (step S3).

On the other hand, when it is determined that the predetermined relief pressure is not detected (NO in step S2), the process returns to step S1.

When it is determined in step S3 that the position control of blade 50 is started, a current is outputted to left pitch/tilt cylinder 72 next (step S4). Specifically, controller 20 outputs a current to EPC valve 84H. Accordingly, left pitch/tilt cylinder 72 extends.

Next, it is determined whether or not a difference in the stroke amounts exhibits a predetermined value (step S5). Specifically, controller 20 determines whether or not the difference in the stroke amounts between right lift cylinder 61 and left lift cylinder 62 exhibits $\Delta L3$.

In step S5, when it is determined that the difference in the stroke amounts does not exhibit a predetermined value (NO in step S5), the process returns to step S4, and a current is outputted to left pitch/tilt cylinder 72 (step S4), and the process described above is repeated until the difference in the stroke amounts exhibits the predetermined value.

In step S5, when it is determined that the difference in the stroke amounts have the predetermined value (YES in step S5), a current to left pitch/tilt cylinder 72 is stopped, and a current is outputted to right pitch/tilt cylinder 71 (step S6). Specifically, controller 20 stops a current to EPC valve 84H, and outputs a current to EPC valve 83H. Accordingly, extension of left pitch/tilt cylinder 72 is stopped, and right pitch/tilt cylinder 71 extends.

Next, it is determined whether or not the difference in the stroke amounts is eliminated (step S7). Specifically, controller 20 determines whether or not the difference in the stroke amounts between right lift cylinder 61 and left lift cylinder 62 is eliminated.

In step S7, when it is determined that the difference in the stroke amounts is not eliminated (NO in step S7), the process returns to step S6, and a current is outputted to right pitch/tilt cylinder 71, and the process described above is repeated until the difference in the stroke amounts is eliminated.

In step S7, when it is determined that the difference in the stroke amounts is eliminated (YES in step S7), a current to right pitch/tilt cylinder 71 is stopped (step S8). Specifically, controller 20 stops a current to EPC valve 83H. Accordingly, extension of right pitch/tilt cylinder 71 is stopped.

This operation can eliminate the difference in the stroke amounts between right lift cylinder 61 and left lift cylinder 62 to render blade 50 to be horizontal.

Then, the process ends (END).

In the position control process for the blade, with the pitch-back operation, the case of starting the position control triggered by the case where the predetermined relief pressure is detected is described. However, the trigger is not limited to this, and the position control can be started in accordance with other conditions. For example, a button or the like dedicated to instruct to the position control for the blade may be provided to execute the process of the position control for the blade in accordance with the selective instruction of the button. Specifically, the process from step S4 may be executed after starting the process of the position control in accordance with the selective instruction of the button, and driving both right pitch/tilt cylinder 71 and left pitch/tilt cylinder 72 to one stroke ends.

<Pitch Initial Adjustment Function>

The pitch initial adjustment function is a function of adjusting a tilt of the blade when blade 50 is disposed to bulldozer 1. Executing the pitch initial adjustment function allows obtaining data of the extension rate and the difference in the stroke amounts as illustrated in FIG. 8.

The instruction of the pitch initial adjustment is given as setting instruction through operation panel 100. The setting instruction is given by a manager through operation panel 100 as a factory default.

Although it is not illustrated in the drawings, by giving the instruction at the management screen for a manager on operation panel 100, an instruction of executing the pitch initial adjustment function is inputted to controller 20.

Controller 20 outputs a control signal to control valve 47 in accordance with an instruction from operation panel 100. Specifically, both right pitch/tilt cylinder 71 and left pitch/tilt cylinder 72 are driven to one stroke ends. Controller 20 obtains from lift stroke sensors 63 the difference in the stroke amounts of right lift cylinder 61 and left lift cylinder 62 in this state. Moreover, controller 20 drives left pitch/tilt cylinder 72 from this state to other stroke end. Controller 20 obtains from lift stroke sensors 63 the difference in the stroke amounts of right lift cylinder 61 and left lift cylinder 62 in this state.

Figure 10:
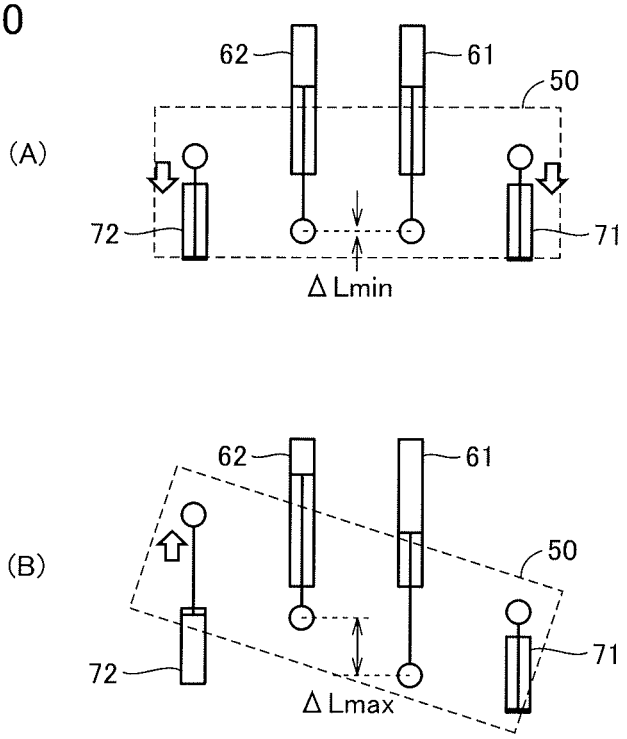
FIG. 10 illustrates a state of blade 50 in a pitch initial adjustment mode in accordance with the embodiment.

FIG. 10 illustrates a state of blade 50 in a pitch initial adjustment mode in accordance with the embodiment.

As shown in FIG. 10(A), both right pitch/tilt cylinder 71 and left pitch/tilt cylinder 72 are driven to one stroke ends. The difference in the stroke amounts of right lift cylinder 61 and left lift cylinder 62 in this state is obtained from lift stroke sensors 63.

In this example, the difference in the stroke amounts is represented as a minimum value ΔLmin.

As shown in FIG. 10(B), left pitch/tilt cylinder 72 is driven to the other stroke end. The difference in the stroke amounts of right lift cylinder 61 and left lift cylinder 62 in this state is obtained from lift stroke sensors 63.

In this example, the difference in the stroke amounts is represented as a maximum value ΔLmax.

The data illustrated in FIG. 8 can be obtained based on the obtained difference in the stroke amounts. The difference ΔL1 of the stroke amounts is a minimum value ΔLmin, and the difference ΔL2 is a maximum value ΔLmax.

Figure 11:
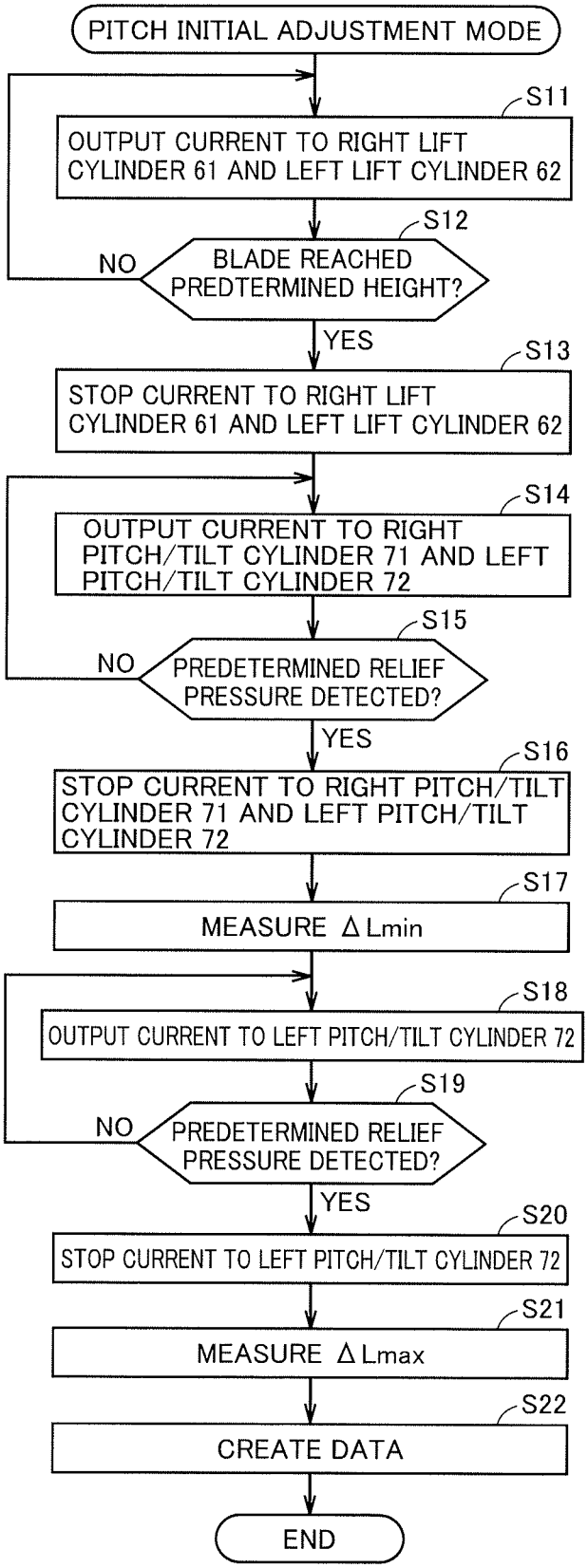
FIG. 11 is a flowchart representing a pitch initial adjustment process in accordance with the embodiment.

FIG. 11 is a flowchart illustrating the pitch initial adjustment process in accordance with the embodiment.

As shown in FIG. 11, controller 20 outputs a current to right lift cylinder 61 and left lift cylinder 62 (step S11). Specifically, controller 20 outputs a current to EPC valves 81H, 82H. Accordingly, right lift cylinder 61 and left lift cylinder 62 contract.

Next, it is determined whether or not the blade has reached a predetermined height (step S12). Specifically, controller 20 obtains from lift stroke sensors 63 the stroke amounts of right lift cylinder 61 and left lift cylinder 62 to determine whether or not the blade has reached the predetermined height. It is determined that blade 50 has reached the predetermined height when the stroke amounts of right lift cylinder 61 and left lift cylinder 62 are greater than or equal to a predetermined value. The pitch initial adjustment process is executed in the state where blade 50 has reached the predetermined height. This is for the purpose of not allowing blade 50 to come in contact with the ground surface since the tilting operation of allowing blade 50 to tilt rightward at most by driving left pitch/tilt cylinder 72 to the other stroke end is performed.

In step S12, when it is determined that the blade has not reached the predetermined height (NO in step S12), the process returns to step S11 and the process described above is repeated.

Next, in step S12, when it is determined that the blade has reached the predetermined height (YES in step S12), a current to right lift cylinder 61 and left lift cylinder 62 is stopped (step S13). Specifically, controller 20 stops an output of current to EPC valves 81H, 82H. Accordingly, contraction of right lift cylinder 61 and left lift cylinder 62 is stopped.

Next, a current is outputted to right pitch/tilt cylinder 71 and left pitch/tilt cylinder 72 (step S14). Specifically, controller 20 outputs a current to EPC valves 83B, 84B. Accordingly, right pitch/tilt cylinder 71 and left pitch/tilt cylinder 72 contract.

Next, it is determined whether or not a predetermined relief pressure is detected (step S15). Specifically, controller 20 determines whether or not a pump pressure of pipe line 31*a* detected by pump pressure detect sensor 44 exhibits a value of the predetermined relief pressure.

The case where the predetermined relief pressure is detected during contraction of right pitch/tilt cylinder 71 and left pitch/tilt cylinder 72 represents the state where the cylinders are most contracted. Thus, it is understood that this is the case where right pitch/tilt cylinder 71 and left pitch/tilt cylinder 72 have reached one stroke ends.

In step S15, when it is determined that the predetermined relief pressure is not detected (NO in step S15), the process returns to step S14 and the process described above is repeated.

In step S15, when it is determined that the predetermined relief pressure is detected (YES in step S1), a current to right pitch/tilt cylinder 71 and left pitch/tilt cylinder 72 is stopped (step S16). Specifically, when it is determined that the pump pressure of pipe line 31*a* detected by pump pressure detect sensor 44 is the predetermined relief pressure, controller 20 stops output of current to EPC valves 83B, 84B.

Next, ΔLmin is measured (step S17). Specifically, controller 20 obtains from lift stroke sensors 63 the stroke amounts of right lift cylinder 61 and left lift cylinder 62 and measures minimum value ΔLmin which is the difference between the stroke amounts.

Next, a current is outputted to left pitch/tilt cylinder 72 (step S18). Specifically, controller 20 outputs a current to EPC valve 84H. Accordingly, left pitch/tilt cylinder 72 extends.

Next, it is determined whether or not the predetermined relief pressure is detected (step S19). Specifically, controller 20 determines whether or not the pump pressure of pipe line 31*a* detected by pump pressure detect sensor 44 has a value of the predetermined relief pressure.

The case where the predetermined pressure is detected during the extension of left pitch/tilt cylinder 72 represents the state where left pitch/tilt cylinder 72 is most extended. Thus, it is understood that left pitch/tilt cylinder 72 has reached the other stroke end.

In step S19, when it is determined that the predetermined relief pressure is not detected (NO in step S19), the process returns to step S18 and the process described above is repeated.

In step S19, when it is determined that the predetermined relief pressure is detected (YES in step S19), a current to left pitch/tilt cylinder 72 is stopped (step S20). Specifically, when it is determined that the pump pressure detected by pump pressure detect sensor 44 is the predetermined relief pressure, controller 20 stops an output of current to EPC valve 84H.

Next, ΔLmax is measured (step S21). Specifically, controller 20 obtains from lift stroke sensors 63 the stroke amounts of right lift cylinder 61 and left lift cylinder 62 and measures maximum value ΔLmax which is the difference between the stroke amounts.

Next, data is created (step S22). Specifically, data shown in FIG. 8 is created based on ΔLmin and ΔLmax.

Then, the process ends (END).

It is possible to execute the position control process of blade 50 described above based on minimum value ΔLmin and maximum value ΔLmax in the pitch initial adjustment process.

In the present embodiment, the case is described in which both minimum value ΔLmin and maximum value ΔLmax are measured. However, when the value of minimum value ΔLmin is negligible, only maximum value ΔLmax may be measured. In such a case, ΔL3 may be set as maximum value ΔLmax/2. Accordingly, the pitch initial adjustment process can be executed in a simple manner.

Figure 12:
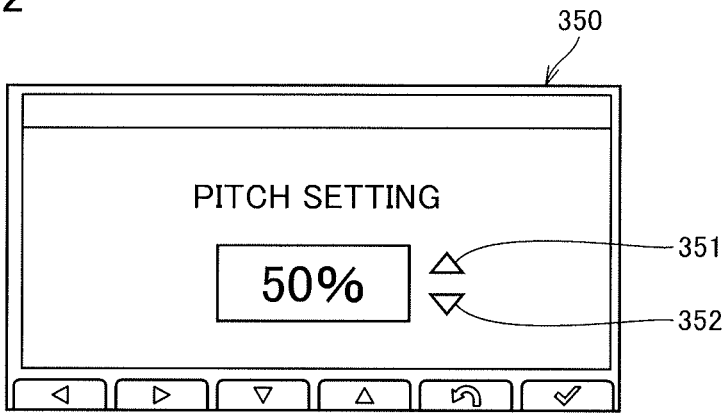
FIG. 12 illustrates a pitch setting screen in accordance with the embodiment.

FIG. 12 illustrates a pitch setting screen in accordance with the embodiment.

A pitch setting screen 350 shown in FIG. 12 is displayed in accordance with a selective instruction through a predetermined button, not illustrated, of operation panel 100.

In pitch setting screen 350, in addition to the display of "pitch setting" and "50%," icons 351, 352 capable of raising and lowering the values are provided. The "pitch setting" and "50%" correspond to extension rate α described above. In this example, extension rate α is set to an initial value of 50%.

For example, moving a cursor to icon 351 and selecting it raises the value from "50%." On the other hand, moving a cursor to icon 352 and selecting it reduces the value from "50%." Accordingly, adjustment of the tilt of the blade in the position control can be performed. Specifically, in the position control process, the adjustment can be performed such that raising extension rate α causes blade 50 to tilt forward, and such that lowering extension rate α causes blade 50 to tilt backward. The values set in the pitch setting is stored in storage 20*a*.

In the present embodiment, the case is described in which data shown in FIG. 8 is created by the pitch initial adjustment process. However, not limited to this, data may be stored in storage 20*a* as a factory default based on results simulated in advance.

<Others>

In the description above, the case is described in which the tilt of the blade is adjusted in the position control process. However, the height of the blade can be also adjusted with the tilt of the blade. For example, as illustrated in FIG. 13, it may be determined whether or not the blade has reached a predetermined height, and the position control process of adjusting the tilt of the blade may be adjusted in the state where the blade has reached the predetermined height. Moreover, the height of the blade can be adjusted so as to take the reference position illustrated in FIG. 6 after adjusting the tilt of the blade.

In the description above, the case is described in which the cylinder lengths of lift cylinders 60 are detected with use of lift stroke sensors 63. However, not limited to this method, any method may be employed as long as it has the configuration capable of detecting the cylinder lengths. For example, the cylinder lengths can be calculated based on the amount of hydraulic oil supplied to the lift cylinders.

In this example, the bulldozer is described as an example of the work vehicle. However, it can be applied also to work vehicles such as a hydraulic excavator, a wheel loader, and the like, and can be applied to any thing as long as it is a machine for work provided with a hydraulic cylinder.

Although the present invention has been described above, the disclosed embodiment is by way of illustration in all aspects and is not to be taken by way of limitation. The scope of the present invention is presented in the scope of patent, and is intended to include all the modification within the meaning and scope equivalent to those in the claims.

REFERENCE SIGNS LIST

1 bulldozer; 4 engine; 6 cab; 8 ripper; 8*a* hydraulic cylinder; 10 vehicle body; 31 crawler belt; 17 hydraulic oil tank; 19 operator's seat; 20 controller; 20*a* storage; 24 right side operating device; 25 blade control lever; 26 ripper control lever; 27 left side operating device; 28 traveling control lever; 29 lock lever; 30 traveling apparatus; 31*a* pipe line; 31*b* servo valve; 32 sprocket wheel; 40 lift frame; 43 hydraulic pump; 44 pump pressure detector; 47 control valve; 49 operation detector; 50 blade; 51 blade edge; 60 lift cylinder; 61 right lift cylinder; 62 left lift cylinder; 63 lift stroke sensor.

The invention claimed is:

1. A work vehicle, comprising:

a vehicle body;

a blade supported on said vehicle body;

a pair of first hydraulic cylinders for moving said blade upward and downward;

a pair of second hydraulic cylinders for tilting said blade forward, backward, leftward, and rightward;

a pair of stroke sensors for detecting stroke amounts of said pair of first hydraulic cylinders; and a controller programmed to control a position of said blade based on a difference in the stroke amounts of said pair of first hydraulic cylinders when, in a state where one said second hydraulic cylinder is at one stroke end or the other stroke end, the other said second hydraulic cylinder is driven from one stroke end to the other stroke end.

2. The work vehicle according to claim 1, wherein said controller drives the other said second hydraulic cylinder from one stroke end to the other stroke end so that the difference in the stroke amounts of said pair of first hydraulic cylinders exhibits a predetermined value, and drives one said second hydraulic cylinder from a state of being at one stroke end or the other stroke end until the stroke amounts of said pair of first hydraulic cylinders match.

3. The work vehicle according to claim 2, wherein said controller sets said predetermined value based on a maximum value at which the difference in the stroke amounts of said pair of first hydraulic cylinders is maximum.

4. The work vehicle according to claim 3, wherein said controller calculates a difference in the stroke amounts of said pair of first hydraulic cylinders in a state where said pair of second hydraulic cylinders are at the one stroke end or the other stroke end as a minimum value, and sets said predetermined value based on said maximum value and said minimum value.

5. The work vehicle according to claim 1, wherein in accordance with an instruction from a manipulator, said controller controls a position of said blade based on a difference in the stroke amounts of said pair of first hydraulic cylinders when one said second hydraulic cylinder is driven so as to be in a state of being at one stroke end or the other stroke end and said other second hydraulic cylinder is driven from one stroke end to the other stroke end.

6. The work vehicle according to claim 2, further comprising an adjustment unit for changing a value of said predetermined value in accordance with an instruction from a manipulator.

7. A method for controlling a work vehicle including a pair of first hydraulic cylinders for moving a blade supported on a vehicle body upward and downward, and a pair of second hydraulic cylinders for tilting the blade forward, backward, leftward, and right ward, the method comprising the steps of:

detecting stroke amounts of said pair of first hydraulic cylinders;

driving one said second hydraulic cylinder so as to be in a state of being at one stroke end or the other stroke end;

driving the other said second hydraulic cylinder from one stroke end to the other stroke end so that a difference in the stroke amounts of said pair of first hydraulic cylinders exhibits a predetermined value; and driving one second hydraulic cylinder from the state of being at one stroke end or the other stroke end until the detected stroke amounts of said pair of first hydraulic cylinders match.

* * * * *